US005771908A

United States Patent [19]

Dorsey

[11] Patent Number: 5,771,908

[45] Date of Patent: Jun. 30, 1998

[54] HAIRCLIP

[75] Inventor: John Dorsey, Mission Viejo, Calif.

[73] Assignee: O'Dorsay, Inc., Mission Viejo, Calif.

[21] Appl. No.: 719,479

[22] Filed: Sep. 25, 1996

[51] Int. Cl.[6] ..... A45D 8/00

[52] U.S. Cl. ..... 132/275; 132/276

[58] Field of Search ..... 132/273, 275, 132/276, 245, 248, 280, 281, 282, 250, 253, 254; D28/10, 39, 41, 37; 63/20

[56] References Cited

U.S. PATENT DOCUMENTS

| | | | |
|---|---|---|---|
| Re. 21,704 | 2/1941 | Caldora | 132/249 |
| 1,287,626 | 12/1918 | Brett | 132/273 |
| 2,164,135 | 6/1939 | Kassover | 132/250 |
| 2,601,428 | 6/1952 | Bonneau | 132/246 |
| 3,271,977 | 9/1966 | Bohlinger et al. | 63/20 |
| 3,751,769 | 8/1973 | Reiner | 132/273 |
| 5,154,196 | 10/1992 | Moffat | 132/275 |
| 5,289,834 | 3/1994 | Lawrence | 132/273 |
| 5,388,598 | 2/1995 | Whitten | 132/275 |

*Primary Examiner*—Todd E. Manahan
*Assistant Examiner*—E. Robert
*Attorney, Agent, or Firm*—Morland C. Fischer

[57] ABSTRACT

The hairclip has an elongated central body. Adjacent one end, the body has a slot therein. A flexible but non-elastic band has a loop at each end. One loop engages in the slot. The length of the body and band are such that, when the slot end of the band is in position, the opposite end can be pulled over the tip of the body. Then, the slot end can be pulled back to tighten the band. The band and body are preferably ornamentally formed.

20 Claims, 2 Drawing Sheets

HAIRCLIP

FIELD OF THE INVENTION

This invention is directed to a hairclip which can be easily positioned in a woman's hair to hold the hair in place and to be decorative.

BACKGROUND OF THE INVENTION

Women's hair styles include long hair, and when the woman does not want this long hair hanging over her face, she must use a device to hold her hair back. A wide variety of hairclips is available, but a useful hairclip must incorporate the advantages of easy installation, firm holding of the hair, and decorative character.

SUMMARY OF THE INVENTION

In order to aid in the understanding of this invention, it can be stated in essentially summary form that it is directed to a hairclip having an elongated central body. Adjacent one end, the body has a slot therein. A flexible but non-elastic band has a loop at each end. One loop engages in the slot. The length of the body and band are such that, when the slot end of the band is in position, the opposite end can be pulled over the tip of the body. Then, the slot end can be pulled back to tighten the band. The band and body are preferably ornamentally formed.

It is thus a purpose and advantage of this invention to provide a hairclip which can be easily installed so as to retain hair in position.

It is another purpose and advantage of this invention to provide a hairclip which is ornamental and easy to use so that it is convenient to employ.

It is another purpose and advantage of this invention to provide a hairclip which is economic to manufacture so that it can be widely distributed.

It is a further purpose and advantage of this invention to provide a hairclip which has no organic elastic members therein so that it does not adversely age so that it is available over a long lifetime to provide an ornamental way of holding the hair in place.

Other purposes and advantages of this invention will become apparent from a study of the following portion of the specification, the claims and the attached drawings.

DESCRIPTION OF THE PREFERRED EMBODIMENT

Figure 1:
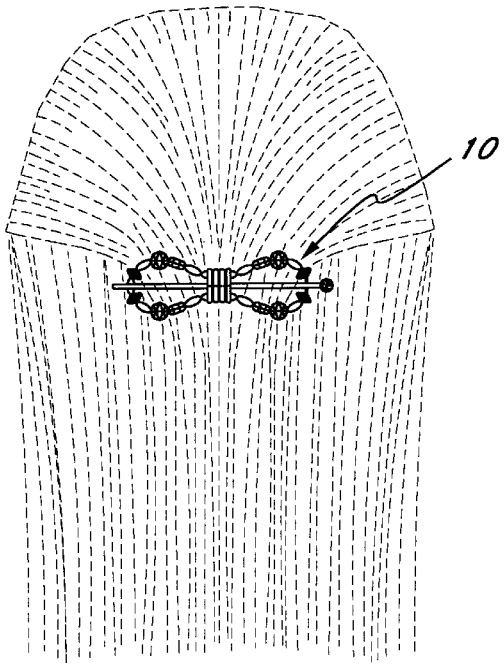
FIG. 1 is an elevational view of the hairclip of this invention, shown applied to the hair on the back of the woman's head, shown in dashed lines.
Figure 2:
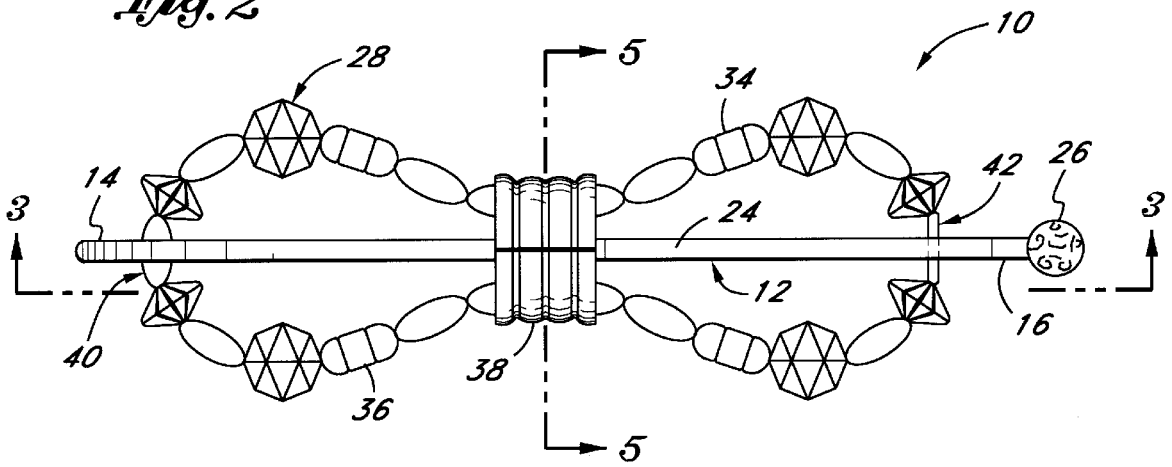
FIG. 2 is an enlarged view thereof.
Figure 3:
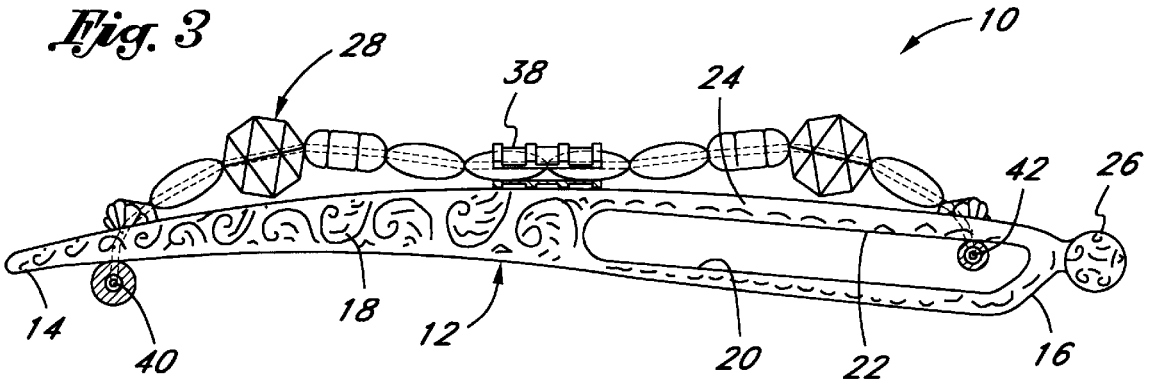
FIG. 3 is a section taken generally along line 3—3 of FIG. 2.
Figure 4:
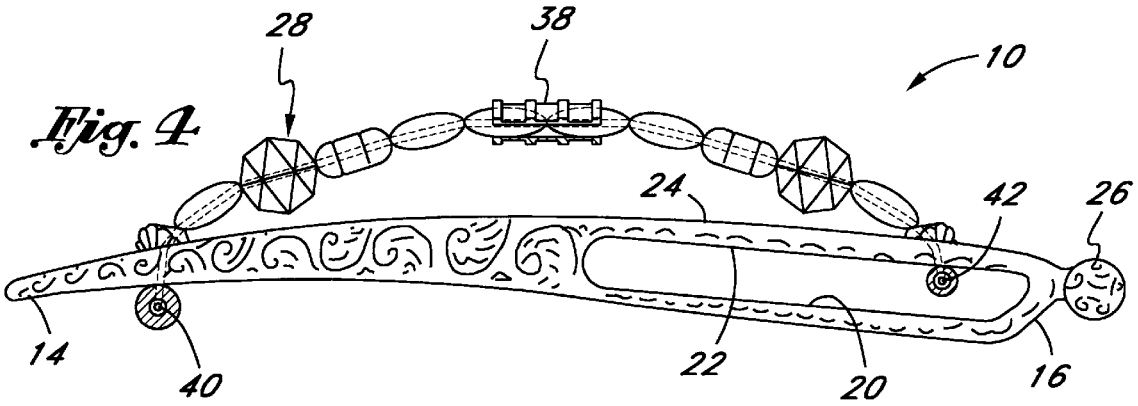
FIG. 4 is a view similar to FIG. 3, but showing the flexible band as it would be positioned when it is around hair.
Figure 5:
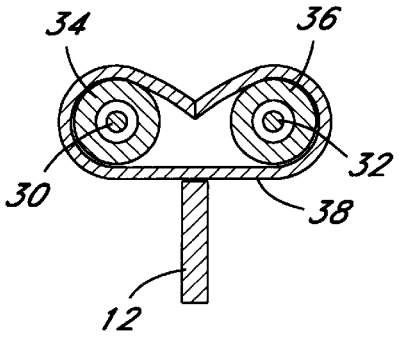
FIG. 5 is an enlarged section taken generally along line 5—5 of FIG. 2.

The hairclip of this invention is generally indicated at 10 in FIGS. 1, 2, 3 and 4. The hairclip 10 is comprised of an elongated central body 12. The central body 12 has a tip end 14 and a head end 16. The cross section of the central body is rectangular as is shown in FIG. 5, but there are surface decorations on the sides of the central body. These surface decorations are shown at 18 in FIGS. 3 and 4. The body 12 is preferably metallic to give a reasonable strength and service life, but, in some cases, may be made of synthetic polymer composition materials. Body 12 has a slot 20 therein adjacent its head end. The slot extends from close to the head end almost to the center of the body 12. The rib 22, which defines the top of the slot, is of substantially uniform thickness with respect to the top edge 24 of the body. Thus, the body adjacent the slot is substantially straight. To the left of the central line, which is substantially at the left end of the slot 20, as seen in FIGS. 3 and 4, the body is tapered down to a substantial point at the tip 14. In addition, the left end of the body is slightly downwardly curved, as shown in FIGS. 3 and 4. The right end of the body has a knob 26 which serves as a handle during application of the hairclip 10.

Non-elastic band 28 is formed of first and second stands 30 and 32 of the same flexible wire, such as multi-stranded plated twisted steel wire. The wire is stiff enough to hold the looped shape of the band. Beads, such as sets of beads 34 and 36 are strung on these wire loops. The beads may be any decorative and ornamental arrangement. It is convenient for the centers of the flexible wires carried by beads 34 and 36 to be clamped together such as by clamp 38. The clamp, similar to the body 12, is made of metal and is suitably ornamented and colored as by plating.

The stands 30 and 32 of the flexible wires form loops. Loop 40 is shown adjacent the tip end of the body, and loop 42 is shown adjacent the head end of the body. The loop 42 engages through the slot 20 and around rib 22. The loop 42 is loose enough to be able to slide along the length of the slot 20. The loop 40 can slip over the smaller tip end 14, and engage under the body as the loop 40 is moved to the right. The length of the non-elastic body is such that, when the loop 42 is moved to the left end of the slot 20, the loop 40 can be placed over the tip and then moved to the right, as shown in FIGS. 3 and 4. Thereupon, the loop 42 is moved to the right to tighten the band 28. This holds the band in position.

In use, the loop 42 is moved to the left, and the loop 40 is freed from the tip end of the body. The handle end of the body is grasped and maneuvered to insert the tip end of the body through the hair, with the hair to be clipped on the top of the body. The top is the side toward the band 28. The body is inserted into the hair, and when in desired position, the user places the loop 40 over tip 14 and then thrusts the body to the left, while holding loop 42. This pulls the loop 40 to the position shown in FIGS. 2, 3 and 4. Loop 42 is pulled to the right toward handle 28 to tension the band 28 around the bundle of hair. The loop 42 is pulled to the right to achieve the desired tension to the band. In this way, a decorative hairclip is achieved. The decorative hairclip is capable of being easily placed and locked in place so that it is secure. Despite the great security, it can be readily removed by release of the locked loop 42. The non-elastic character of the band provides a structure of long life and repeatable utilization.

This invention has been described in its presently preferred best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A hairclip comprising:

an elongated central body having a tip end and a head end and a slot in said elongated central body extending from adjacent said head end toward said tip end;

a flexible inelastic band formed with a first loop and a second loop, said first and second loops being arranged end-to-end one another;

said first loop being received in and movable through said slot; and said second loop being sized to fit over said tip end of said elongated central body, said inelastic band being of such length so that when said first loop is at the end of said slot toward said tip end, said second loop will fit over and around said tip end and when said first loop is moved through said slot away from said tip end and towards said head end, said second loop is engaged and retained by said tip end.

2. The hairclip of claim 1 wherein said elongated central body is ornamentally decorated.

3. The hairclip of claim 1 wherein said slot in said elongated body defines a rib and said rib is of substantially constant cross section and said rib is engaged by said first loop.

4. The hairclip of claim 3 wherein said elongated body is tapered from adjacent said slot to said tip end.

5. The hairclip of claim 4 wherein said elongated central body is ornamentally decorated.

6. The hairclip of claim 1 wherein said elongated body is tapered from adjacent said slot to said tip end.

7. The hairclip of claim 1 wherein said inelastic band is a flexible metallic band.

8. The hairclip of claim 7 wherein said flexible metallic band is ornamented.

9. The hairclip of claim 8 wherein said ornamentation of said flexible metallic band comprises beads on said flexible metallic band.

10. The hairclip of claim 1 wherein said inelastic band comprises a flexible wire configured to define said first and second loops.

11. The hairclip of claim 10 wherein said flexible metallic band is ornamented.

12. The hairclip of claim 11 wherein said ornamentation of said flexible metallic band comprises beads on said flexible metallic band.

13. The hairclip of claim 11 wherein said elongated central body is ornamentally decorated.

14. The hairclip of claim 11 wherein said slot in said elongated body defines a rib and said rib is of substantially constant cross section and said rib is engaged by said first loop.

15. The hairclip of claim 14 wherein said elongated body is tapered from adjacent said slot to said tip end.

16. The hairclip of claim 1 further comprising a clamp attached to said flexible inelastic band to hold said first and second loops in end-to-end alignment with one another.

17. A hair comprising:

an elongated central body, said elongated central body having a tip end and a head end, a slot in said central body adjacent said head end and extending toward said tip end substantially halfway along said body, said slot defining a rib;

said elongated central body being of smaller cross section adjacent said tip end than at said slot;

a flexible inelastic band forming first and second loops and a clamp located between and separating said first and second loops from one another, said first loop being engaged around said rib, said loop being sized so that it moves freely along said rib;

said second loop being sized to fit over said tip end of said elongated body; and said flexible inelastic band being of such length so that when said first loop is toward the end of said slot toward said tip end, said second loop can be placed and removed over said tip end and when said first loop is moved toward said head end, the second loop can engage under said tip end to retain said second loop.

18. The hairclip of claim 17 wherein both said elongated central body and said inelastic band are ornamented.

19. The hair clip of claim wherein said inelastic band has a wire running therethrough for forming said first and second loops.

20. The hairclip of claim 19 wherein there is a manually graspable knob secured on said head end of said elongated central body.

* * * * *